US005503013A

United States Patent [19]

Zeller

[11] Patent Number: 5,503,013

[45] Date of Patent: Apr. 2, 1996

[54] DOWNHOLE MEMORY GAUGE PROTECTION SYSTEM

[75] Inventor: Vincent P. Zeller, Flower Mound, Tex.

[73] Assignee: Halliburton Company, Houston, Tex.

[21] Appl. No.: 283,964

[22] Filed: Aug. 1, 1994

[51] Int. Cl.[6] ..... E21B 47/00

[52] U.S. Cl. ..... 73/151

[58] Field of Search ..... 73/151, 706, 707

[56] References Cited

U.S. PATENT DOCUMENTS

| | | | |
|---|---|---|---|
| 3,744,307 | 7/1973 | Harper et al. | 73/152 |
| 3,911,972 | 10/1975 | Hubers et al. | 141/7 |
| 4,567,921 | 2/1986 | King | 141/5 |
| 4,780,862 | 10/1988 | Clerke | 367/166 |

*Primary Examiner*—Hezron E. Williams

*Assistant Examiner*—Daniel S. Larkin

*Attorney, Agent, or Firm*—William M. Imwalle; Shawn Hunter

[57] ABSTRACT

A buffer insert is emplaceable within a memory gauge system buffer chamber. The buffer insert includes a reduced diameter, extended inlet conduit that attaches to the buffer chamber opening. The inlet conduit employs capillary repulsion to impede entrance of wellbore fluid into the buffer chamber. The inlet conduit forces infiltrating fluids to enter proximate the top of the chamber rather than its bottom. The insert further includes an extended curled capillary allowing restricted fluid communication between the chamber and the transducer. Entrance to the curled capillary is located proximate the bottom of the buffer chamber, thereby forcing infiltrating fluids to travel downward through the more viscous silicon oil. Testing has shown the system of the present invention to greatly reduce contact with the transducer components by infiltrating wellbore fluids.

18 Claims, 2 Drawing Sheets

DOWNHOLE MEMORY GAUGE PROTECTION SYSTEM

BACKGROUND OF THE INVENTION

1. Field of the Invention

The present invention relates generally to an apparatus and method for protection of fragile sensors. More particularly, it relates to a system using a buffer insert for improved protection of transducers used in the oil and gas industry.

2. Description of Related Art

Downhole memory gauge systems may be used to measure, record, store, and/or transmit information concerning environmental conditions and physical phenomena, such as temperature and pressure, in locations within and about a wellbore. In many cases, the information is important for establishing and regulating operating parameters for downhole procedures. Known gauge systems typically employ one or more sensors that are capable of sampling a particular condition, such as temperature or pressure, and means for recording and storing or transmitting this information for interpretation at the surface. More advanced gauge systems include features for monitoring changing well conditions, conserving power, and for evaluating the sensor's own status. Some gauge systems are self-contained in that they obtain and store information within themselves for use only after the system has been extracted from the wellbore. Others are capable of transmitting information to remote locations for real time readouts. Commonly, this will be surface readout of downhole well conditions.

A popular and effective pressure sensor used in the oil and gas industry is a quartz crystal transducer that relays signals via gold conductor strips to insulated copper transmission wires. Information about well conditions would be most accurately gathered by emersing the crystal directly in the wellbore fluids. Contact of the transducer with wellbore fluids may, however, invalidate the readings and damage the transducer. The crystal, gold strips, wires and epoxies used to connect the gold strips to the wires are susceptible to damage from chemicals and contaminants found in wellbore fluids, such as $H_2S$, Other sensor types include sensitive components that may be similarly harmed.

Oil and grease filled chambers have historically been used to safeguard crystal transducers. The transducer is emersed in the oil and grease chamber and located therein. The oil and grease will not harm the crystal and therefore provides an effective barrier to the harmful fluids. These more viscous and substantially incompressible fluids are retained within the chamber by the naturally occurring capillary attraction between the oil and grease and the walls of the chamber.

Protection against wellbore fluids is particularly important in systems that are self-contained and may remain downhole for extended periods of time. Over time, wellbore fluids tend to infiltrate gauge systems and reach the components of the transducer. Fluid may infiltrate the gauge systems by physically displacing protective oil surrounding the transducer or contaminants and gases may dissolve into the surrounding oil and migrate to the crystal.

In current systems, a crystal transducer acting as a sensor is placed within a chamber that is connected to a buffer system. The buffer system is covered with a surrounding outer housing having an interior that defines a buffer chamber. The crystal chamber and the buffer chamber are in fluid communication with the wellbore therefore the sensor may be exposed to the potentially harmful external conditions to be monitored. The silicon oil in the crystal chamber may be contaminated by wellbore fluids entering through the outer housing and passing through the buffer system. One buffer system includes a single, helical or curled capillary tube, known as a buffer tube, that is positioned adjacent to the crystal chamber and within the outer housing. The tube allows fluid communication between the wellbore and the interior of the crystal chamber. Capillary attraction between the oil and the interior walls of the tube slows progress of the wellbore fluid toward the crystal transducer. For contaminating fluids or solids to reach the crystal, they must either displace, dissolve into, or pass through the oil along the length of the capillary tube. This arrangement, however, is only effective to a limited degree in preventing wellbore contaminants from reaching the transducer components.

Alternatively, closed systems that eliminate the opening between the crystal chamber and wellbore are known. These systems incorporate an accordion-like folded metal bellows within the outer housing. Closed systems are less sensitive to wellbore parameters than open systems. They are also not field serviceable since it is not practical to service and fill the closed housing. Additionally, if the closed system is opened, re-calibration of the sensor contained therein may be necessary.

SUMMARY OF THE INVENTION

This invention effectively provides two buffer chambers, one within the other, that are included in a communications path between the wellbore and the crystal sensor. Since a primary goal of the present invention is to prevent contaminating fluids and solids from directly contacting the sensor, an extended and tortuous communication path is provided between the well fluids and the sensor. Heavy fluids, such as oils and greases, are employed as barriers within the buffer chambers and communications path. In a typical configuration, a first buffer chamber closest to the well fluid is filled with a viscous grease and a second and interior buffer chamber is filled with less viscous oil. Both the grease and oil, however, do not support shear forces and therefore transmit pressure differentials along the communications path while at the same time resisting extrusion and displacement from the containment of the path.

The first buffer chamber is created by the exterior housing of the memory gauge system. The second buffer chamber is included within an improved buffer insert that is carried within, and in fluid communication with the first buffer chamber. A reduced diameter, extended length conduit is provided between the two buffer chambers. An inlet to the conduit is open to the first buffer chamber and a length of the conduit extends within the buffer insert to an outlet that is located proximate to a top end of the second buffer chamber. The conduit is filled with oil and because of the conduit's relatively small diameter and extended length, the oil tends to remain therein and resist displacement due to the oil's capillary attraction to the interior walls of the conduit. In this way, the oil filled conduit serves as a contaminant resistant barrier. Any fluid that is displaced from the conduit flows from the outlet into the top end of the second buffer chamber. An outlet from the second chamber is located proximate a bottom end. Therefore, the second chamber itself provides a buffering distance over which a contaminating fluid or solid must pass before fouling the sensor. The outlet from the second chamber serves as an inlet into a curled capillary tube that provides the next section of communications path. Like the conduit and second buffer chamber, the curled capillary tube is filled with silicon oil that is resisting movement along the communications path due to capillary attraction.

The buffer insert impedes effective infiltration of wellbore fluids through dual resistance paths. The first resistance path includes the inlet conduit that resists entrance of wellbore fluids to the buffer chamber. The second resistance path includes the extended curled capillary and impedes migration of wellbore fluid chemicals and contaminants toward the transducer.

Testing has shown the system of the present invention to greatly reduce contact between the transducer and wellbore fluids.

DETAILED DESCRIPTION OF THE PREFERRED EMBODIMENTS

Figure 1:
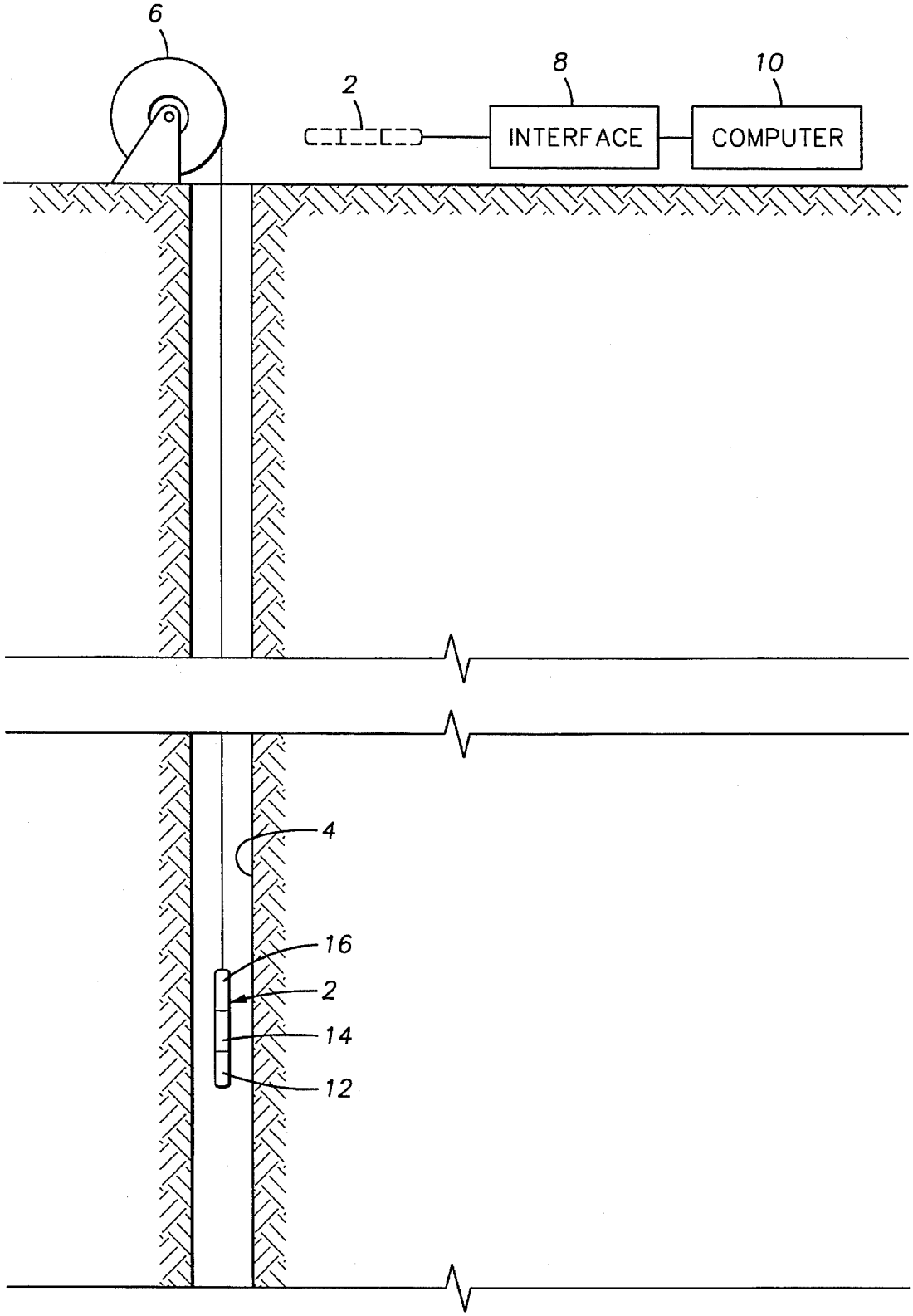
FIG. 1 (PRIOR ART)
FIG. 1 shows an exemplary schematic illustration of a self-contained downhole gauge system shown in a downhole location and, in dot-dash lines, in a surface location connected by an interface to a computer.

Referring first to FIG. 1, an exemplary memory gauge system of the self-contained variety is illustrated. Although this type of system is described in much greater detail in U.S. Pat. No. 5,153,832, issued to Anderson et al., and assigned to the assignee of the present invention, it will be briefly discussed here. A self-contained downhole gauge 2 is disposed in a wellbore 4 by a suitable hoisting or tool carrier means 6 of a type known in the art. For example, the carrier 6 may be a wireline either having or not having the ability to transmit data from the gauge to the surface. Alternatively, the carrier 6 may be a drill string of which the gauge 2 is a part and that is raised and lowered such as by a draw works and traveling block as known in the art.

FIG. 1 also shows the gauge 2 located at the surface and connected by an electronic interface 8 to a computer system 10 in a dot-dash outline. Where a self-contained gauge is used, communications do not occur between the surface and the gauge 2 when the gauge 2 is located in the wellbore 4. The interface 8 and the computer system 10 are, therefore, used to communicate with the gauge 2 only when it is at the surface. Such communications can occur, prior to lowering the gauge 2 into the wellbore 4, for the purpose of entering information or presetting variables within the gauge 2 or, after the gauge 2 has been withdrawn from or extracted from the wellbore 4, for reading the stored information from the gauge 2 into the computer system 10 so that the information can be analyzed.

As described further in U.S. Pat. No. 5,153,832, an exemplary gauge 2 is made of three detachable segments or sections that are electrically and mechanically interconnectable through multiple conductor male and female connectors that are mated as the sections are connected. These three sections are contained within respective linearly interconnectable tubular metallic housings of suitable types as known in the art for use in downhole environments. As illustrated in FIG. 1, the three sections of gauge 2 include (1) a transducer section 12, (2) a controller/power converter and control/memory section 14 and (3) a power source/battery section 16.

Figure 3:
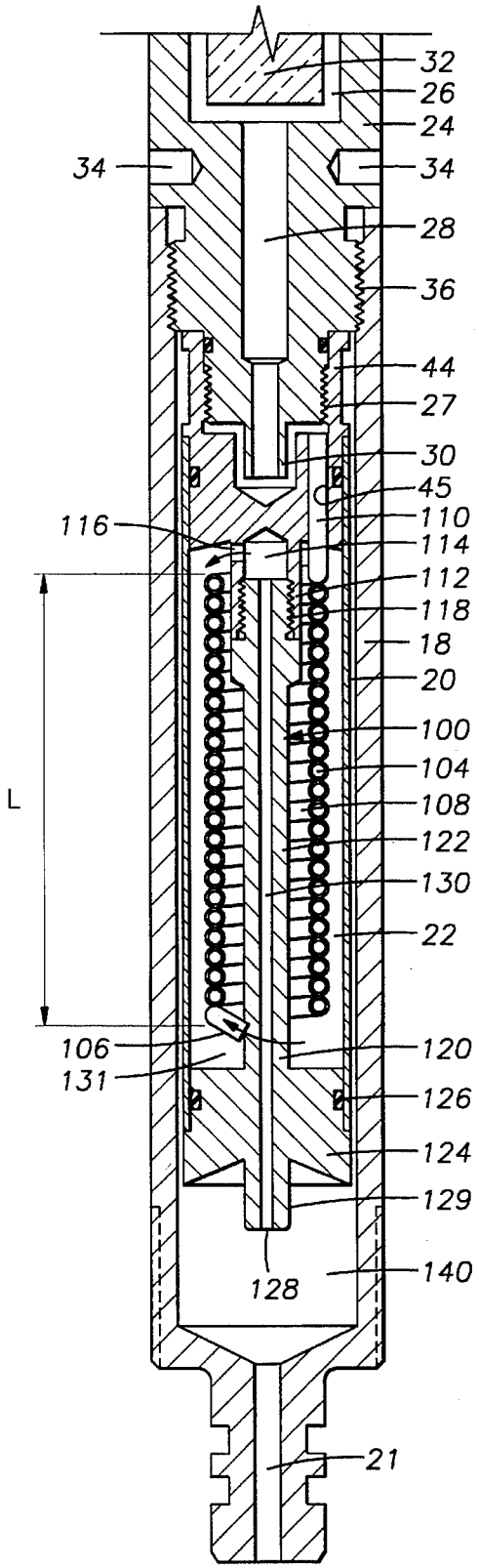
FIG. 3 shows a buffer system constructed in accordance with the present invention.

Referring now to FIG. 3, there is shown an exemplary transducer section 12 that incorporates a buffer system constructed in accordance with the present invention. It is also noted that connections between components, where not specifically described, are shown schematically and comprise known connection techniques such as threading and the use of elastomeric O-ring type seals and metal-to-metal (MTM) seals for fluid tightness where appropriate. The transducer section 12 generally includes an outer housing 18 and a transducer housing 24 that supports a buffer insert 100. The insert 100 includes a second or buffer chamber 22 that is initially filled with a heavy, viscous oil.

The exterior of the outer housing 18 is disposed into the well 4 and emersed in the wellbore fluids. Outer housing 18 includes a downwardly facing opening or inlet 21 into a first chamber 140 created within the interior of the housing 18 that is typical of an open system and that permits fluid access to the internal components of the gauge 2 such that wellbore conditions may be reliably monitored.

The transducer housing 24 features a sensor or transducer chamber 26 having a downwardly facing fluid communication port 28 ending in a nipple 30. Transducer 32 is maintained within the chamber 26 and typically comprises a quartz-type crystal transducer. The transducer housing 24 may include lateral sockets 34 for use in assembly and disassembly of the gauge. External threads 36 secure the transducer section 12 to the lower outer housing 18.

The buffer insert 100 within transducer section 12 includes an upper connector 44, a stem 120, a second conduit or primary capillary 104, and an inner housing 20. Upper connector 44 is received in the upper end of inner housing 20 and is connected, via threaded connection 27, to nipple 30. The lower end of transducer housing 24 is received within an enlarged bore in the upper end of connector 44. Connector 44 also includes a reduced diameter bore for receiving nipple 30. The depth of these bores is greater than the related projecting portions of transducer housing 24, thereby forming a generally annular gap. An annular gap is in fluid communication with the port 28 at nipple 30.

Upper connector 44 includes a side port 45 therethrough and a centrally disposed, downward facing connector 112 having a threaded central bore 114 and lateral ports 116 (one shown). The connector 112 is attached by threaded connection 118 to the upper end of stem 120. Stem 120 includes a narrow upper section 122 and an enlarged base 124 that is received within the lower end of inner housing 20 and connected to housing 20 at 126 by threading and/or O-ring type elastomeric seals. A narrow secondary capillary or bore 130 extends the length of stem 120 from its upper end at central bore 114 to its lower end in enlarged base 124 forming an orifice 128. The bore 130 also defines a first conduit. An annular or second chamber 22 is formed between upper section 122 of stem 120 and inner housing 20. Upper connector 44 and base 124 close the ends of inner housing 20. Fluid communication is provided between chamber 22 and bore 114 by lateral ports 116. Preferably, the base 124 includes a recessed nipple 129 to which a vacuum hose (not shown) may be attached to clean the unit after use.

A primary capillary or second conduit 104 in the form of a tube is spirally wound around upper section 122 and includes a downwardly facing inlet 106 located proximate the bottom of chamber 22, an extended helical or curled intermediate section 108, and an outlet 110 that is disposed in side port 45 through the upper connector 44 to permit fluid communication between the chamber 22 and the annular gap. It is noted that the intermediate section 108 has a length L that extends over a majority of the length of the interior chamber 22. Preferably, L is greater than 75% of the interior length of the chamber 22.

In operation, the buffer insert 100 provides improved resistance to fluid migration while maintaining the sensitivity of an open system. Effectively, the buffer insert 100 provides multiple fluid resistance paths in series. Fluid migration is initially impeded into the buffer chamber 22 by capillary attraction along the length of secondary capillary 130. Once the wellbore fluid or contaminants traverse the length of the secondary capillary 130, they are outletted into central bore 114 and, through lateral ports 116, the top of the buffer chamber 22. The buffer insert thereby provides a first fluid resistance path that resists migration from orifice 128 to areas proximate the top of chamber 22. Once inside the buffer chamber 22, the fluid and contaminants are diluted within the silicon oil. Because of the viscous nature of the silicon oil, the wellbore fluids and contaminants will tend to remain localized proximate the top of the chamber 22 rather than spread throughout chamber 22.

Most wellbore fluid and contaminants will tend to remain proximate the top of the chamber 22 as they are lighter or less dense than the silicon oil within the chamber 22. Now diluted and generally localized near the top of chamber 22, wellbore fluids and contaminants must negotiate a second fluid resistance path to further migrate toward transducer 32. From the top of chamber 22, the resistance path continues downwardly through the chamber 22 to the bottom 131, into the downwardly facing port 106 of primary capillary 104 and upward through the primary capillary 104 to outlet 110. Capillary attraction along the intermediate section 108 impedes fluid migration. The amounts of wellbore fluids and contaminants that are ultimately capable of reaching outlet 110 and subsequently entering port 28 from annular gap are negligible, even over a long period of time. A preferred internal diameter for primary and secondary capillaries 104 and 130 in most applications is approximately 0.063".

Figure 2:
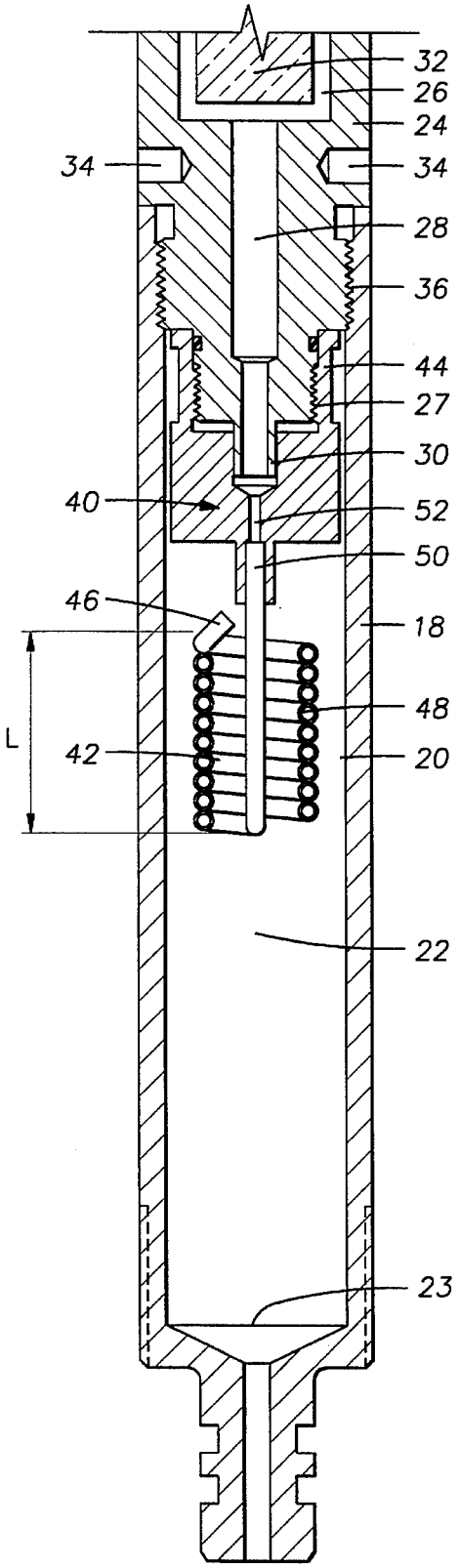
FIG. 2 (PRIOR ART)
FIG. 2 shows a prior art buffer tube arrangement.

FIG. 2 illustrates a prior art buffer tube arrangement 40 disposed within housing 18 and attached to the transducer housing 24 by threaded connection 27. Prior art buffer tube arrangement 40 includes an upper connector 44. A capillary or Bourdon tube 42 is disposed with the chamber 22 that is formed within housing 18. Capillary tube 42 has an inlet 46, an intermediate helical or curled portion 48 and an outlet 50. Upper connector 44 maintains capillary tube 42 within the chamber 22 such that the inlet 46 is upwardly opening and maintained proximate the top of chamber 22. Outlet 50 is maintained in alignment with the port 28 and nipple 30. A central passageway 52 within the upper connector 44 permits fluid communication between the outlet 50 and the port 28.

It is noted that in the prior art arrangement of FIG. 2, infiltrating wellbore fluid has direct access to the interior of the buffer chamber 122 through opening 23, that is relatively large. Typically, the opening 23 is approximately one inch in diameter. As may be appreciated, this arrangement permits upwardly migrating wellbore fluids to infiltrate the protective silicon oil within chamber 22 across a wide area. To reach the crystal transducer 32, infiltrating wellbore fluid and contaminants within the fluid must travel upward through the opening 23 into the upper portion of chamber 122 before they can enter inlet 46. Once fluid and contaminants have entered inlet 46, they must negotiate the length of the intermediate helical portion 48 and enter port 28 through outlet 50. The intermediate portion 48 is curled or formed in a helical manner. The prior art intermediate portion 48 extends a longitudinal distance L that is less than half of the available longitudinal dimension of chamber 122. As a result of the greater length L' of the intermediate section 108 of the present invention, resistance to contamination is improved over the prior art.

A 45-day field test of a buffer insert arrangement constructed in accordance with the described embodiment of the present invention has been conducted. A memory gauge system containing the insert was placed inside a dynamic gas well and subjected to an average operating temperature of 325° and pressure of 5000–8000 psi. The sensor provided readings for the entire 45 day period. At the end of the test, the gauge system was extracted from the well and examined. No wellbore fluid had reached the sensor components. Contamination resistance of this order, using an open gauge system, is unprecedented.

While the invention has been described with respect to certain preferred embodiments, it should be apparent to those skilled in the art that it is no so limited. It is to be understood, for example, that the transducer, controller and other portions of gauge 2 may be of any known types. Components may be differently shaped and application may be found outside the oil and gas industry. Various other modifications may be made without departing from the spirit and scope of the invention.

What is claimed is:

1. A memory gauge for determining downhole environmental parameters, said gauge comprising:

(a) a power source;

(b) a controller/power converter section;

(c) a transducer section, comprising:

(1) a ported transducer housing;

(2) a transducer disposed within said housing;

(3) a buffer chamber defined by a buffer chamber housing, the buffer chamber being disposed below said transducer housing; and (4) a buffer insert within said buffer chamber, said buffer insert comprising:

a. a first fluid resistance path to impede fluid flow into a buffer chamber, the first path including a capillary tube; and b. a second fluid resistance path to impede fluid flow from the buffer chamber to a transducer within the memory gauge system, the second path including a capillary tube.

2. The memory gauge of claim 1 wherein the capillary tube of the second fluid resistance path comprises a coiled intermediate section within the buffer chamber, the intermediate section having a length that extends over a majority of the interior length of the buffer chamber.

3. The memory gauge of claim 2 wherein the coiled intermediate section has a length of at least 75% of the interior length of the buffer chamber.

4. The memory gauge of claim 2 wherein the capillary tube of the second fluid resistance path includes a generally downwardly facing inlet.

5. The memory gauge of claim 1 wherein the capillary tube of the first fluid resistance path includes an outlet proximate the top of the buffer chamber.

6. The memory gauge of claim 5 wherein the outlet comprises a lateral port permitting fluid to be communicated from the capillary tube into the buffer chamber.

7. A buffer insert for placement within a transducer buffer chamber of a memory gauge system, the buffer insert comprising:

(a) a first fluid resistance path to impede fluid flow from the exterior of a buffer chamber into a buffer chamber, the first path including a capillary tube; and (b) a second fluid resistance path to impede fluid flow from the buffer chamber to a transducer within a memory gauge system, the second path including a capillary tube.

8. The buffer insert of claim 7 wherein the capillary tube of the second fluid resistance path comprises a coiled intermediate section, the intermediate section having a length that extends over a majority of the interior length of the second buffer chamber.

9. The buffer insert of claim 8 wherein the coiled intermediate section has a length at least 75% of the interior length of the second buffer chamber.

10. The buffer insert of claim 8 wherein the capillary tube of the second fluid resistance path includes a generally downwardly facing inlet.

11. The buffer insert of claim 7 wherein the capillary tube of the first fluid resistance path includes an outlet, the outlet capable of communicating fluid from the capillary tube to an area proximate the top of the second buffer chamber when the buffer insert is emplaced within the first buffer chamber.

12. The buffer insert of claim 11 wherein the outlet comprises a lateral port permitting fluid communication from the capillary tube into the second buffer chamber.

13. A buffer system for protecting a transducer mounted within a housing with a fluid bore, said transducer being in communication with a wellbore for receiving information on wellbore fluids, the buffer system comprising:

an enclosure adapted to be mounted on the housing;

said enclosure having a first closed end with a first bore therethrough for communication with the fluid bore and a second closed end having a second bore therethrough in fluid communication with wellbore fluids;

said enclosure having an annular chamber formed by a longitudinal member extending between said first and second closed ends;

said second bore extending from the second closed end through said longitudinal member;

said longitudinal member including a transverse bore communicating said second bore with said annular chamber adjacent said first closed end;

a capillary tube helically wound around said longitudinal member and disposed within said annular chamber, said capillary tubes having a first end connected to said first bore in said first closed end and a second end open adjacent said second closed end;

a passage being formed by said second bore, said annular chamber, said capillary tube, and said first bore, said passage being filled with oil;

whereby the wellbore fluids must migrate the entire length of said passage to move the transducer.

14. The buffer system of claim 13 wherein said first closed end is above said second closed end causing the well fluids with a lighter density than said oil to accumulate in said annular chamber adjacent said transverse bore thereby preventing the wellbore fluids from reaching the transducer.

15. A buffer system for a fragile sensor used to evaluate environmental conditions, said buffer system having a communications path comprising:

a first chamber open to the environment at an inlet;

a second chamber fluidly connected to said first chamber by a first conduit;

a sensor chamber fluidly connected to said second chamber by a second conduit;

said first and second conduits each having an inlet and an outlet;

said first and second chambers and said first and second conduits filled with a fluid sufficiently viscous to be retained therein as a result of capillary attraction between said fluid and the interior walls of the chambers and conduits; and the outlet of said first conduit being distally located within the second chamber from the inlet of the second conduit by a distance approximating a length of said second chamber thereby causing any fluid exiting the first conduit to be dumped into said second chamber away from and without direct transfer to said second conduit.

16. The buffer system as defined in claim 15, wherein said second conduit is a coiled capillary tube.

17. The buffer system as defined in claim 15, wherein a crystal transducer serves as a sensor located within the sensor chamber.

18. The buffer system as defined in claim 15, wherein said second chamber is contained within the first chamber.

* * * * *